United States Patent [19]

Orloff et al.

[11] 4,068,560

[45] Jan. 17, 1978

[54] FLUID-POWERED STEPPING MOTOR

[75] Inventors: George Orloff, Solihull; Peter Ian Munnoch, Hall Green; Alan Thomas, Stratford-on-Avon, all of England

[73] Assignee: Lucas Industries Limited, Birmingham, England

[21] Appl. No.: 715,090

[22] Filed: Aug. 17, 1976

[30] Foreign Application Priority Data

Aug. 30, 1975 United Kingdom ..... 35848/75

[51] Int. Cl.[2] ..... F15B 21/02; F01B 1/06

[52] U.S. Cl. ..... 91/36; 91/491

[58] Field of Search ..... 91/476–481, 91/491, 492, 498

[56] References Cited

U.S. PATENT DOCUMENTS

| | | | |
|---|---|---|---|
| 2,101,829 | 12/1937 | Benedek | 91/498 |
| 3,075,504 | 1/1963 | Vogel | 91/39 |
| 3,464,316 | 9/1969 | Orloff | 91/491 |
| 3,599,536 | 8/1971 | Myers | 91/488 |
| 3,661,059 | 5/1972 | Hunter et al. | 91/192 |
| 3,796,525 | 3/1974 | Kilmer | 91/491 |
| 3,848,515 | 11/1974 | Gardineer | 91/192 |
| 3,985,065 | 10/1976 | Nonnenmacher | 91/498 |
| 4,004,498 | 1/1977 | Aoki | 91/476 |

FOREIGN PATENT DOCUMENTS

| | | | |
|---|---|---|---|
| 1,177,776 | 4/1959 | France | 91/498 |
| 1,254,849 | 11/1971 | United Kingdom | 91/498 |

*Primary Examiner*—William L. Freeh

*Attorney, Agent, or Firm*—Ladas, Parry, Von Gehr, Goldsmith & Deschamps

[57] ABSTRACT

A hydraulic-powered motor for stepwise operation has a plurality of radial pistons in a rotatable cylinder block, the pistons engaging a cam track having a number of indentations which is different from the number of the pistons. Electrically operated valves are provided and are energizable in sequence to apply pressure pulses to the pistons to cause stepwise rotation of the cylinder block. Detent means may be provided to prevent rotation of the cylinder block in the absence of a pressure pulse to any one of the pistons.

11 Claims, 9 Drawing Figures

FIG.1.
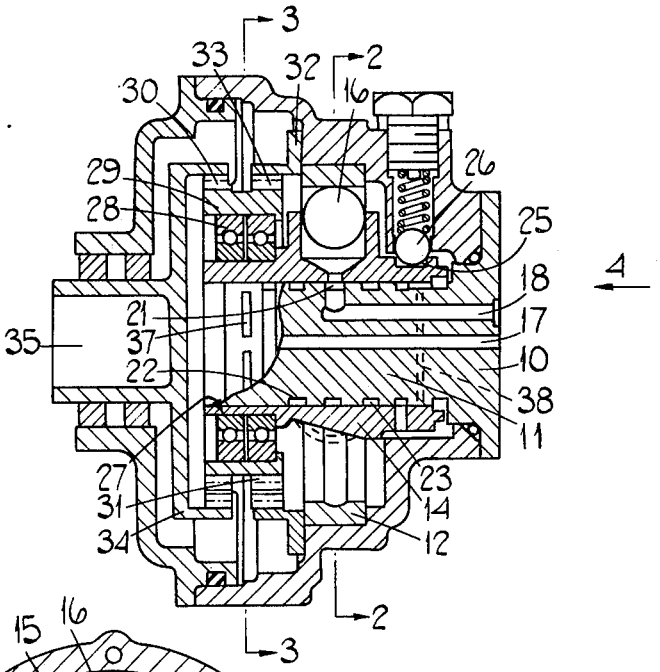
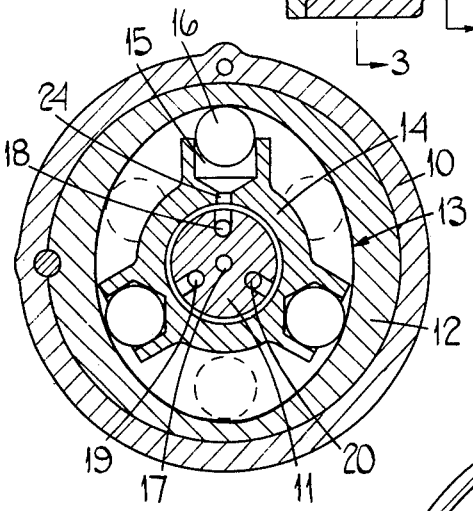
FIG.2.
FIG.3.
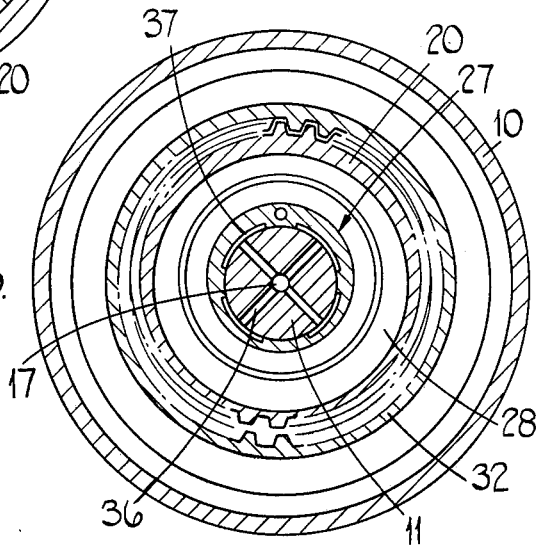

FLUID-POWERED STEPPING MOTOR

This invention relates to fluid-powered stepping motors.

According to the invention a fluid-powered stepping motor comprises a body, a cam track, a cylinder member mounted on said body for rotation relative to said cam track, said cylinder member having at least three radial bores therein, piston elements slidable in the respective bores and being engageable with said cam track, and means, responsive to input control signals, for sequentially applying fluid pressure pulses to said bores, said cam track including a surface having a plurality of zones whose distance from said cylinder progressively decreases substantially symmetrically on either side of a centre part of each zone, whereby a pressure pulse applied to one piston in contact with one of said zones can cause relative rotation between said body and said cylinder member to a position in which said one piston engages said one zone substantially at said centre part thereof.

Embodiments of the invention will now be described by way of example only and with reference to the accompanying drawings in which:

FIG. 1 is a longitudinal section through a fluid powered stepper motor,

FIGS. 2 and 3 are sections on corresponding lines in FIG. 1,

Figure 4:
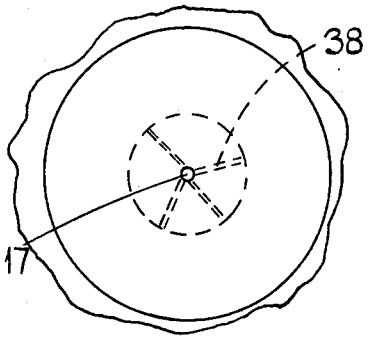
FIG. 4 is a view on arrow 4 in FIG. 1.

As shown in FIGS. 1 to 4 a motor has a body 10 which includes a pintle portion 11. Secured within the body 10 is a cam track 12 having an elliptical internal surface 13. Mounted on the pintle 11 for rotation within the body 10 is a cylinder member 14. The cylinder member 14 has three equi-angularly spaced radial bores 15, a ball piston 16 being slidable within each bore 15 and being engageable with the surface 13 of cam track 12.

Pintle 11 is provided with a central passage 17, whose purpose will be explained, and three further passages 18, 19, 20 which surround the passage 17. Passages 18, 19, 20 communicate with respective axially-spaced circumferential grooves 21, 22, 23 on the pintle 11. The radial bores 15 have ports 24 which are also axially spaced so as to communicate with respective ones of the grooves 21, 22, 23.

The cylinder member 14 is provided with six equispaced recesses 25 which are engageable by a spring loaded ball 26 to tend to restrain movement of the cylinder member 14 from any one of six angular positions with respect to the body 10. The angular positions of the cam track 12, bores 15, recesses 25 and ball 26 are such that rotation of the cylinder member 14 is restrained by the ball 26 in positions which correspond to engagement of any one of the ball pistons 16 with the surface 13 at the maximum distance thereof from the axis of the pintle 11.

The cylinder member 14 has an outer surface portion 27 which is eccentric with respect to the axis of the pintle 11. Mounted on the portion 27 by means of bearings 28 is a ring 29 having axially-spaced rows 30, 31 of external gear teeth. A ring 32 is secured to the body 10 and has internal gear teeth 33 arranged concentrically with the axis of the pintle 11. An internally-toothed ring gear 34 is mounted for rotation concentrically with the pintle axis and has a hub 35 which passes sealingly through the wall of the body 10. The ring gear 34 has a different number of teeth to the ring 32. The rows 30, 31 of teeth on the ring 29 respectively mesh with the teeth on rings 34, 32. A single rotation of the cylinder member 14 thus causes the ring gear 34 to rotate by an amount dependent on the difference between the numbers of teeth on this gear and the ring 32.

In a preferred embodiment a group of four passages 36 extend radially, as shown in FIG. 3, from the central passage 17, and communicate with lubrication grooves 37 adjacent one end of the bore in the cylinder 14. A further group of radial passages, indicated at 38, extend from the central passage 17 to lubrication grooves in the other end of the central bore of the cylinder member.

Figure 5:
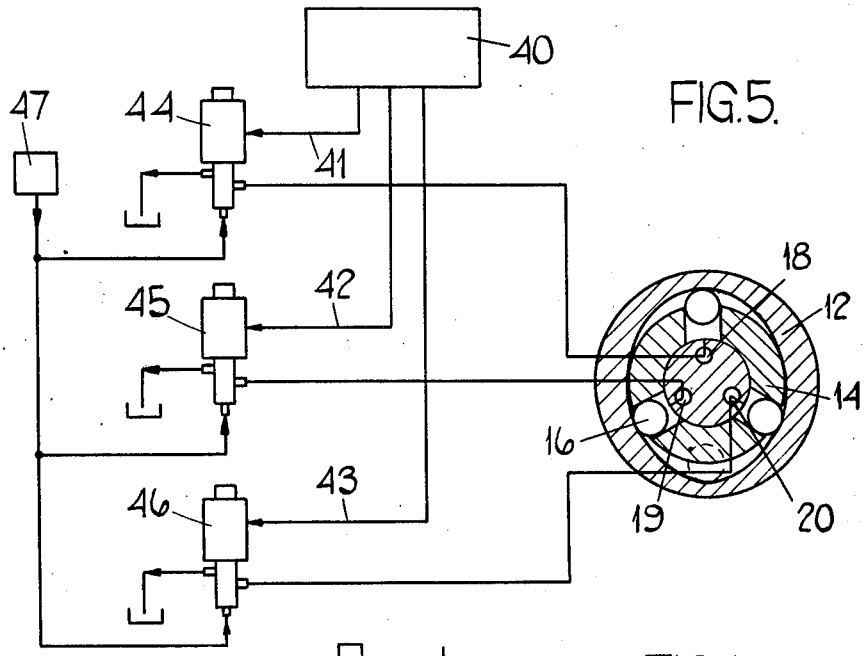
FIG. 5 shows, diagrammatically, a control apparatus for the motor of FIGS. 1 to 4.

As shown in FIG. 5, the motor has an associated electronic control circuit 40 which can be programmed to provide electrical pulses in a desired sequence on respective ones of lines 41, 42, 43. Control valves 44, 45, 46 are responsive to electric pulses on the respective lines 41, 42, 43 to apply fluid pressure pulses from a source 47 to respective ones of the three passages 18, 19, 20.

With the cylinder member 14 in the position shown in FIG. 5 a fluid pulse applied to passage 18 will maintain the cylinder member 14 stationary with respect to the cam track 12. A fluid pulse applied to passage 19 will, in the absence of pulses in passages 18, 20, urge the cylinder member 14 anti-clockwise, until the ball piston 16 associated with passage 19 reaches a point of maximum eccentricity of the internal surface of the cam track 12, thereby rotating the cylinder member 14 through an angle of 60°. A fluid pulse applied to passage 20 will similarly rotate the cylinder member 14 clockwise through an angle of 60°. The motor may thereby be rotated in 60° steps in a direction dependent on the sequence of pulses applied to lines 41, 42, 43.

The cylinder member 14 may be maintained in its step positions by means of the spring loaded ball 26. This will, however, impart a friction load opposing operation of the motor. In a preferred arrangement shown in FIG. 6 the ball 26 can be urged into engagement with the recesses 25 by a fluid pressure, instead of by a spring. To this end a further control valve 50 is responsive to control signals on a line 51 from the circuit 40. The arrangement is such that a biasing pressure is applied by valve 50 to the ball 26 at all times except when a fluid pulse is appled to any one of the passages 18, 19, 20. The restraint applied by ball 26 is thus removed during rotation of the cylinder member 14.

For further reduction of friction in the motor during rotation thereof a valve 52 is responsive to a control signal on a line 53 from circuit 40 to apply a fluid pressure pulse to the central passage 17, and thereby to the lubricating grooves in the central bore of the cylinder member 14. The arrangement is such that the pressure pulse applied to passage 17 coincides with the application of a pressure pulse to any one of the passages 18, 19, 20.

In the absence of a fluid pressure pulse in passage 17 friction between the pintle 11 and the cylinder member 14 assists in maintaining the motor stationary in the absence of actuating pressure pulses to any of the passages 18, 19, 20.

Figure 7:
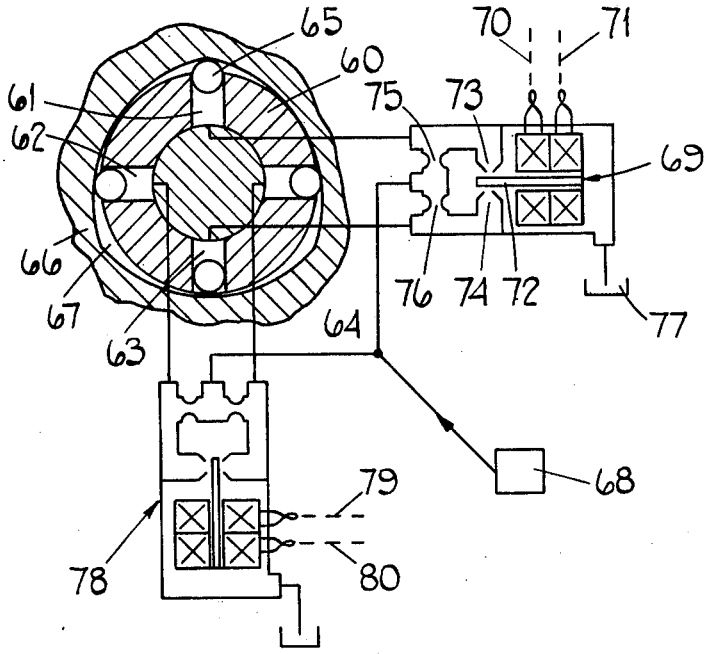

The alternative form of motor shown in FIG. 7 has a cylinder member 60 with four equi-spaced radial bores 61, 62, 63, 64 in which bore pistons 65 are slidable. The pistons 65 engage the inner surface of a cam track 66 having three equi-angularly spaced zones 67 of maximum eccentricity with respect to the axis of the cylinder member 60.

A fluid actuating pressure can be selectively applied from a source 68 to bore 61 or to bore 63 by means of a torque motor 69. Torque motor 69 is responsive to electrical control pulses on respective lines 70, 71 to urge a control element 72 to shut off either one of a pair of nozzle outlets 73, 74. Outlets 73, 74 are respectively in series with flow restrictors 75, 76 between the pressure source 70 and a low pressure drain 77. A further, similar torque-motor controlled valve arrangement 78 is responsive to electrical control signals on respective lines 79, 80 to apply fluid actuating pressures to bores 62, 64 respectively. The electrical control signals on lines 70, 71, 79, 80 are applied thereto by a programmed control circuit (not shown) similar to the circuit 40 previously referred to. The arrangement is such that a fluid operating pressure is applied simultaneously to one of the bores in the pair 61, 63 and to one of the bores in the pair 62, 64.

In the operating position shown the ball piston 65 in bore 61 is engaged with one of the zones 67 of maximum eccentricity of the surface of the cam track 66. A fluid operating pressure applied to bore 61 will then maintain the cylinder member 60 stationary with respect to the cam track 66, whichever of the bores 62, 64 is being supplied with an operating pressure by valve arrangement 78.

Assume that bore 62 is pressurised and that torque motor 69 is subsequently operated to apply pressure to bore 63 and remove it from bore 61. Cylinder member 60 will then move anti-clockwise until the ball piston in bore 62 engages the next adjacent zone 67 of maximum eccentricity. In this position the cylinder member 60 is maintained stationary. Subsequent operation of valve arrangement 78 to apply pressure to bore 64 will cause the ball piston 65 in bore 63 to move the cylinder member 60 by another anti-clockwise step. Selective operation of the valve arrangement can thus rotate the cylinder member 60 in 30° steps.

In a like manner, and starting from the position shown in the drawing, operating pressures are applied to bores 63, 64 the cylinder member 60 will move clockwise by a 30° step.

The cylinder member 60 may thus be rotated clockwise or anti-clockwise in 30° steps, by selective operation of the torque motor control valves.

Figure 6:
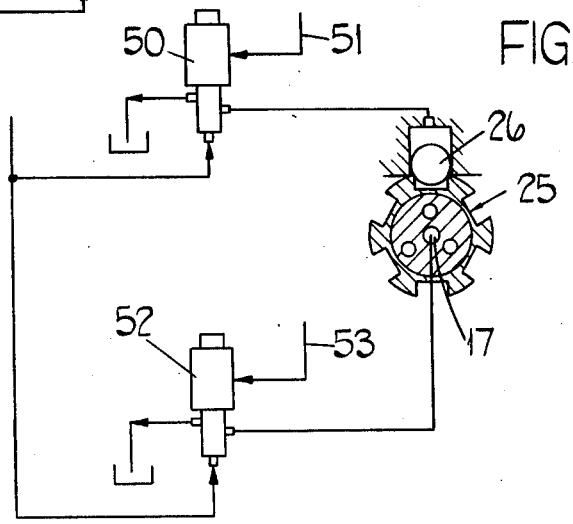
FIG. 6 shows, diagrammatically, a modification of the motor and control apparatus of FIGS. 1 to 5, FIGS. 7 and 8 show, diagrammatically, alternative forms of motor, together with their associated control apparatus.

It will be apparent that either or both of the detent and lubricating pulse arrangements, previously described with reference to FIG. 6, may also be incorporated in the motor of FIG. 7.

Figure 8:
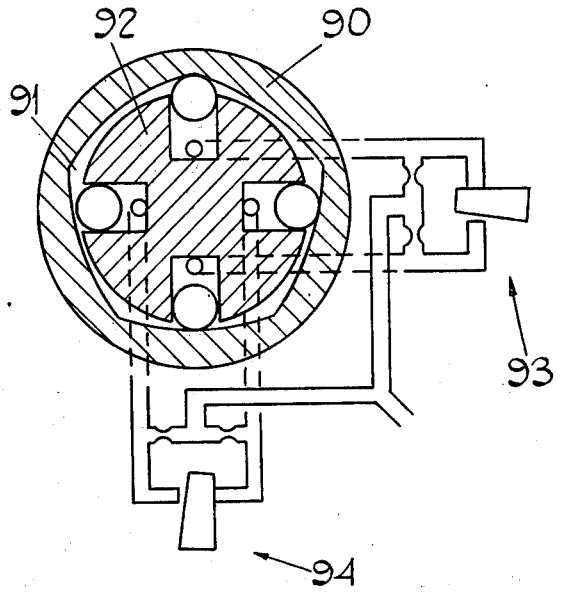

FIG. 8 shows a motor which is generally similar to that of FIG. 7, but which has a cam track 90 having five equi-angularly spaced zones 91 of maximum eccentricity with respect to the axis of a cylinder member 92. Torque motor controlled valve arrangements 93, 94 are operable, as before, to apply operating pressures to a selected one in each of two pairs of diametrically opposed bores in the cylinder member 92. Sequential operation of the valve arrangements 93, 94 by a control circuit causes relative rotation, either clockwise, or anti-clockwise, between the cylinder member 92 and the cam track 90.

In the embodiments disclosed with reference to FIGS. 1 to 7, the cam track has been described as maintained stationary and the cylinder member as rotating. It will be understood, however, that in alternative arrangements the cylinder member could be maintained stationary and the cam track allowed to rotate, an output drive from the motor being taken from the cam track. Such an arrangement is, in fact, that shown in FIG. 8, whereby the motor does not include a pintle for supporting the cylinder member 92.

Figure 9:
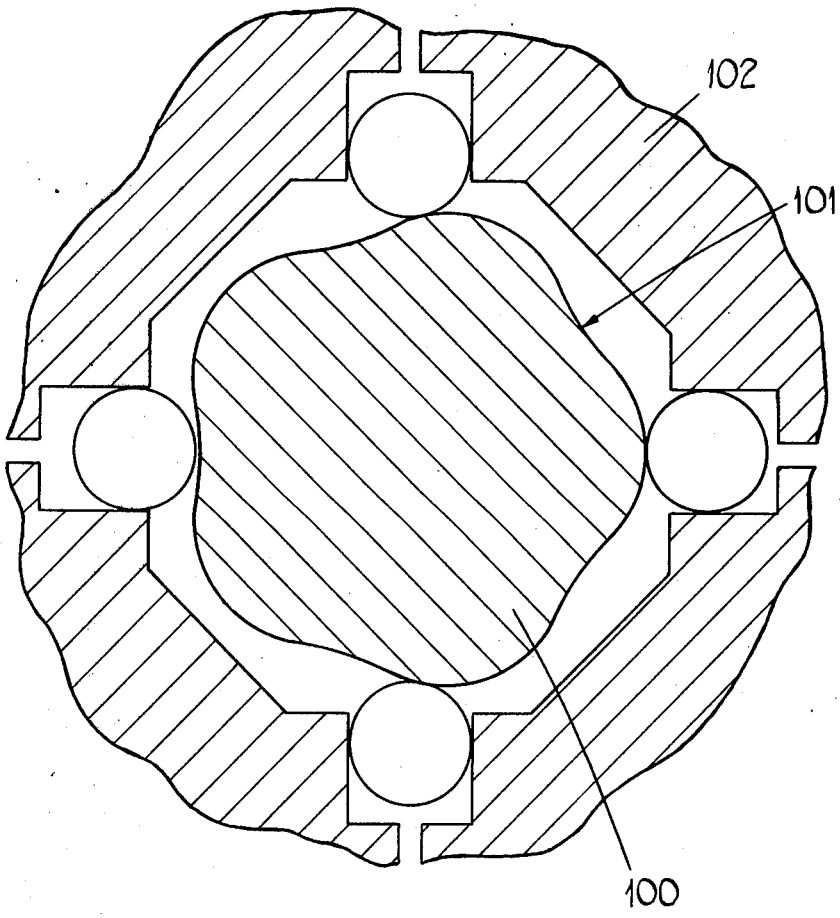
FIG. 9 shows, diagrammatically, a further alternative form of motor.

The embodiment indicated in FIG. 9 is functionally identical to that shown in FIG. 8, but has a cam track 100 with an external surface having five zones 101 of maximum distance from a surrounding cylinder member 102. This embodiment operates in a like manner to that of FIG. 8 to provide relative rotation between the cam track 100 and the cylinder member 102, in 18° steps. The motor output drive is conveniently taken from the cam track 100, the cylinder member 102 being maintained stationary, but it will be appreciated that, if required, the motor output drive could be taken from rotation of the cylinder member 102.

It will be further understood that, if required, the detent and lubrication arrangements described with reference to FIG. 6 may be incorporated in either of the embodiments of FIGS. 8 or 9.

We claim:

1. A fluid-powered stepping motor comprising a body, a cam track, a cylinder member mounted on said body for rotation relative to said cam track, said cylinder member having at least three radial bores therein, piston elements slidable in the respective bores and being engagable with said cam truck, means, responsive to input control signals, for sequentially applying fluid pressure pulses to said bores, said cam track including a surface having a plurality of zones whose distance from said cylinder progressively decreases substantially symmetrically on either side of a centre part of each zone, and means, operable in synchronism with said fluid pressure pulse applying means, for supplying pulses of lubricating fluid between relatively sliding faces of said body and said cylinder member only when said body and said cylinder member are urged into relative rotation by said fluid pressure pulses, whereby a sequence of said fluid pressure pulses causes step-wise relative rotation between said body and said cylinder member and in the intervals between said pressure pulses frictional resistance to said relative rotation is increased.

2. A stepping motor as claimed in claim 1 in which the number of said piston elements is less than the number of said zones.

3. A stepping motor as claimed in claim 1 in which said cylinder member is mounted internally of said cam track.

4. A stepping motor as claimed in claim 1 in which said cylinder member is mounted externally of said cam track.

5. A stepping motor as claimed in claim 1 which includes a gear means for providing an output movement the speed of which is reduced from the speed of relative rotation between said cam track and said cylinder member.

6. A stepping motor as claimed in claim 1 in which said radial bores and said cam track are so arranged that, when one of said pistons is engaging said centre part of one of the zones, two others of said pistons are respectively engaging two others of said zones at parts thereof which are spaced in first and second rotational directions respectively from the centre parts of said two other zones.

7. A stepping motor as claimed in claim 1 in which the number of said piston elements is greater than the number of said zones.

8. A stepping motor as claimed in claim 7 in which there are an even number of equi-angularly spaced piston elements.

9. A stepping motor as claimed in claim 8 in which said means for applying pressure pulses comprises a plurality of electrically-operated valves each of which is selectively operable to apply a fluid pressure to one of said bores or to a diametrally opposite bore.

10. A stepping motor as claimed in claim 1 which includes detent means for restraining said cylinder member from rotation relative to said body.

11. A stepping motor as claimed in claim 10 in which said detent means is responsive to a fluid pressure signal and which includes means for applying said pressure signal in phase with the application of said pressure pulses.

* * * * *